US005505647A

United States Patent [19]

Sato et al.

[11] Patent Number: 5,505,647

[45] Date of Patent: Apr. 9, 1996

[54] METHOD OF MANUFACTURING IMAGE-FORMING APPARATUS

[75] Inventors: Yasue Sato, Kawasaki; Ichiro Nomura, Atsugi; Hidetoshi Suzuki, Fujisawa; Toshihiko Takeda, Atsugi; Naoto Nakamura, Isehara; Yasuhiro Hamamoto, Machida, all of Japan

[73] Assignee: Canon Kabushiki Kaisha, Tokyo, Japan

[21] Appl. No.: 187,502

[22] Filed: Jan. 28, 1994

[30] Foreign Application Priority Data

Feb. 1, 1993 [JP] Japan ..... 5-033968

[51] Int. Cl.[6] ..... H01J 9/26; H01J 1/30

[52] U.S. Cl. ..... 445/25; 445/43; 445/44

[58] Field of Search ..... 445/25, 43, 44

[56] References Cited

U.S. PATENT DOCUMENTS

| | | | |
|---|---|---|---|
| 4,395,244 | 7/1983 | Glaser | 445/25 |
| 4,618,802 | 10/1986 | Schrank | 445/25 |
| 4,666,548 | 5/1987 | Eto et al. | 156/286 |
| 5,066,883 | 11/1991 | Yoshioka et al. | 313/309 |

FOREIGN PATENT DOCUMENTS

| | | | |
|---|---|---|---|
| 0162135A3 | 11/1985 | European Pat. Off. . | |
| 0299461A2 | 1/1989 | European Pat. Off. . | |
| 0388984A3 | 9/1990 | European Pat. Off. . | |
| 52-33474 | 3/1977 | Japan | 445/25 |
| 6431332 | 2/1989 | Japan . | |
| 256822 | 2/1990 | Japan . | |
| 2-299130 | 12/1990 | Japan | 445/25 |
| 2-299131 | 12/1990 | Japan | 445/25 |

OTHER PUBLICATIONS

Patent Abstracts of Japan, vol. 10, No. 69 (E–389) (2126) Mar. 18, 1986 and JP–A 60 218 738.

Dyke et al., "Field Emission," in Advance in Electronics and Electron Physics, L. Marton, ed. pp. 99–185 (1956).

Spindt et al., "Physical Properties of Thin–film Field Emission Cathodes With Molybdenum Cones," J. Appl Phys., 47:5248 (1976).

Mead, "Operation of Tunnel–Emission Devices," J. App. Phys., 32:646 (1961).

Elinson et al., "The Emission of Hot Electrons and the Field Emission of Electrons from Tin Oxide, Radio Engineering and Electronic Physics", 10:1290 (1965).

Dittmer, "Electrical Conductor and Electron Emission of Discontinuous Thin Films", Thin Solid Films, 9:317 (1972).

Hartwell et al., "Strong Electron Emission from Patterned Tin–Indium Thins Films", Int'l Electron Devices Meeting, Washington, D.C. (1975).

Araki et al., "Electroforming and Electron Emission of Carbon Thin Film," J. Vacuum Soc. Jap., 26:22 (1983).

*Primary Examiner*—P. Austin Bradley
*Assistant Examiner*—Jeffrey T. Knapp
*Attorney, Agent, or Firm*—Fitzpatrick, Cella, Harper & Scinto

[57] ABSTRACT

An image-forming apparatus comprising an envelope formed of a plurality of members, an electron source arranged within the envelope and an image forming member for forming images by irradiation of electron beams from the electron source is manufactured by heating the plurality of members to bond them together to produce the envelope in an atmosphere containing at least a gas selected from reducing gases, inert gases and non-reducing and non-oxidizing gases or in a vacuum. The electron source comprises preferably an electron-emitting element having a thin film for electron emission arranged between a pair of electrodes.

8 Claims, 7 Drawing Sheets

METHOD OF MANUFACTURING IMAGE-FORMING APPARATUS

BACKGROUND OF THE INVENTION

1. Field of the Invention

This invention relates to a method of manufacturing an image-forming apparatus such as a display apparatus in which images are formed by irradiation of electron beams and it also relates to an image-forming apparatus manufactured by using said method.

2. Related Background Art

Known electron-emitting elements are currently classified into two categories. Those that are used as thermoelectron sources and those used as cold cathode electron sources. Of these, cold cathode electron sources are normally grouped as one of several types including the field effect emission type (hereinafter referred to as FE type), the metal/insulation layer/metal type (hereinafter referred to as MIM type) and the surface conduction type.

Some FE type devices are proposed in W. P. Dyke & W. W. Dolan, "Fieldemission", Advance in Electron Physics, 8,89 (1956) and C. A. Spindt, "Physical properties of thin-film field emission cathodes with Molybdenum cones", J. Appl. Phys, 47,5248 (1976).

On the other hand, C. A. Mead, "The tunnel-emission amplifier" J. Appl. Phys, 32,646 (1961) describes MIM type devices.

Finally, M. I. Elinson, Radio Eng. Electron Phys., 10 (1965) discloses certain surface conduction electron-emitting elements.

A surface conduction electron-emitting element is a device that utilizes the phenomenon of electron emission that takes place when an electric current is made to flow through a small thin film formed on a substrate in parallel with the surface of the film. Several different surface conduction electron-emitting elements have been reported, including the one comprising an $SnO_2$ thin film as disclosed by Elinson cited above as well as those comprising an Au thin film [G. Dittmer: "thin Solid Films", 9,317 (1972)], an $In_2O_3/SnO_2$ thin film [M. Hartwell and C. G. Fonstad: "IEEE Trans. ED Conf"., 519 (1975)] or a carbon film [H. Araki et al.: "Vacuum, Vol. 26, No. 1, p. 22 (1983)].

FIG. 7 of the accompanying drawings schematically illustrates a device proposed by Hartwell as cited above. Referring to FIG. 7, an electron-emitting region generating thin film 232 is formed of a metal oxide to show an H-shaped pattern on an insulator substrate 231 by sputtering and an electron-emitting region 233 is produced out of the thin film by means of an electrification treatment which is also called a forming operation. Reference numeral 234 denotes a part of the thin film including an electron-emitting region.

A surface conduction electron-emitting element having the above described configuration is normally subjected to an electrification treatment, which is also called forming, in order to produce an electron-emitting region 233 out of the electron-emitting region generating thin film 232. More specifically, forming is an operation of processing a surface conduction electron-emitting element where a voltage is applied to opposite ends of the electron-emitting region generating thin film 232 in order to produce an electrically highly resistive electron-emitting region 233 out of it by locally destroying or deforming it. Once subjected to a forming operation, the surface conduction electron-emitting element emits electrons from the electron-emitting region 233 when a voltage is applied to the thin film 234 including the electron-emitting region 233 to cause an electric current to run through the element.

However, conventional surface conduction electron-emitting elements are accompanied by certain known problems when they are used for practical applications. The applicant of the present patent application has been engaged in a series of research and development efforts in an attempt to solve the problems, which will be described hereinafter.

For example, the applicant of the present patent application has proposed an improved surface conduction electron-emitting element as shown in FIG. 8 (disclosed in Japanese Patent Application Laid-open No. 2-56822) comprising a film of fine particles 244 formed on a substrate 241 between a pair of electrodes (242, 243) as an electron-emitting region generating thin film, which is subjected to an electrification treatment to produce an electron-emitting region 245 out of it.

A large number of surface-conduction electron-emitting devices can be arranged in an array to form a matrix of devices that operates as an electron source, where the devices of each row are wired and regularly arranged to produce columns. (See, for example, Japanese Patent Application Laid-open No. 64-31332 of the applicant of the present patent application.)

Meanwhile, in recent years, flat panel display devices utilizing liquid crystal have been widely used in place of CRTs for image forming apparatuses, although such display devices are disadvantageous in that they are not of emissive type and hence require a light source such as a back light to be installed for operation. Therefore, there has been a strong demand for emissive type display devices.

Emissive type high quality display apparatus having a large display screen have been proposed to meet the demand. Such an apparatuses typically comprises an electron source having a large number of surface conduction electron-emitting elements arranged in array and a phosphor layer designed to emit visible light upon receiving electrons emitted from the electron source. (See inter alia U.S. Pat. No. 5,066,883 of the applicant of the present patent application.)

Now, the basic configuration of an image forming apparatus comprising electron-emitting elements will be summarily described below by referring to FIGS. 4 and 5.

As shown in FIGS. 4 and 5, an image forming apparatus comprises a number of electron-emitting elements 81 arranged on a substrate 85, a face plate 83 typically made of transparent glass, a phosphor layer 84 formed by applying phosphor to the inner surface of the face plate 83, a metal back layer 88, spacers 82 for separating the substrate 85 and the face plate 83 by a given distance, pieces of frit glass 86 for bonding the spacers 82, the face plate 83 and the substrate 85 together to form an envelope of the apparatus and hermetically sealing the envelope and an exhaust pipe 87 for evacuating the envelope. An envelope may alternatively be constituted of an integrally formed face plate 83 and spacer 82 or an integrally formed substrate 85 and spacer 82. The envelope is normally evacuated to a pressure of not higher than $10^{-6}$ torr.

With an image-forming apparatus having a configuration as described above, electron beams are emitted from the electron-emitting elements 81 in accordance with input signals as a high voltage of the order of several kilovolts is applied to the metal back layer 88 so that the emitted electron beams are accelerated before they hit the phosphor layer 84 to produce luminous images on the phosphor layer 84 as a function of input signals.

While an image-forming apparatus comprising an electron source formed by arranging a large number of electron-emitting elements in array is expected as a matter of course to have a large high quality image display screen, it has been proved that such a display screen is not easily obtainable particularly because of manufacture-related problems including the following.

First, during the operation of melting frit glass and bonding the face plate 83, the spacers 82 and the substrate 85 together with molten frit glass to produce an envelope, the entire image-forming apparatus needs to be heated to a temperature as high as 430° C. for approximately sixty minutes to subsequently form an oxide film on the element electrodes of each of the electron-emitting elements and the wiring electrodes for wiring the electron-emitting elements, which by turn can significantly increase the electric resistance of the elements and the wires connecting them. The increase in the electric resistance of the electron-emitting elements and the wires results in a rise of electric energy consumption.

Secondly, it is very difficult to ensure an even distribution of temperature for the apparatus during the above described melting and bonding operation and consequently, the produced oxide film have a thickness and an electric resistances that may vary depending on the location where it is formed. As a result, the electron-emitting elements may emit electrons at different rates to produce improperly illuminated images on the display screen.

Finally, the metal of the element electrodes of the surface conduction electron-emitting elements is apt to be oxidized during the operation particularly at the interfaces of the thin film including an electron-emitting region and the element electrodes of each element to increase the electric resistance of the element so that, at worst, no electricity may be allowed to flow therethrough, making the element totally inoperative. If the operation of forming is carried out for the surface conduction electron-emitting elements after the above described melting and bonding operation, the operation of forming will consume electric energy at an enhanced rate because of the increased electric resistance of the elements due to the melting and bonding operation.

SUMMARY OF THE INVENTION

In view of the above identified problems, it is therefore an object of the invention to provide a method of manufacturing an image-forming apparatus that can minimize the formation of oxide films in and, therefore, the rate of energy consumption of the finished apparatus and reduce the unevenness in the rate of electron emission among the electron-emitting elements of the apparatus so that it can produce high quality images on its display screen along with an image-forming apparatus manufactured by using the same.

Another object of the invention is to provide a method of manufacturing an image-forming apparatus comprising an electron source constituted by surface conduction electron-emitting elements that can operate at a low electric energy consumption rate to produce high quality images on its display screen.

According to a first aspect of the invention, the above objects and other objects are achieved by providing a method of manufacturing an image-forming apparatus comprising an envelope formed by a plurality of members, an electron source arranged within said envelope and an image forming member for forming images by irradiation of electron beams from said electron source, characterized in that said method comprises a step of heating said plurality of members to bond them together to produce said envelope in an atmosphere containing at least a gas selected from reducing gases, inert gases and non-reducing and non-oxidizing gases or in a vacuum.

According to a second aspect of the invention, there is provided a method of manufacturing an image-forming apparatus comprising an envelope formed by a plurality of members, an electron source arranged within said envelope and an image forming member for forming images by irradiation of electron beams from said electron source, characterized in that said method comprises a step of applying a bonding agent to predetermined areas of the surfaces of said plurality of members followed by calcination and a step of heating said plurality of members to bond them together to produce said envelope in an atmosphere containing at least a gas selected from reducing gases, inert gases and non-reducing and non-oxidizing gases or in a vacuum.

According to a third aspect of the invention, there is provided a method of manufacturing an image-forming apparatus comprising an envelope formed by a plurality of members, an electron source arranged within said envelope and comprising an electron-emitting element having an electroconductive film including an electron-emitting region arranged between a pair of electrodes, and an image forming member for forming images by irradiation of electron beams from said electron source, characterized in that said method comprises a step of heating said plurality of members to bond them together to produce said envelope in an atmosphere containing at least a gas selected from reducing gases, inert gases and non-reducing and non-oxidizing gases or in a vacuum, said step being carried out prior to a step of generating an electron-emitting region in the electroconductive film.

According to a fourth aspect of the invention, there is provided a method of manufacturing an image-forming apparatus comprising an envelope formed by a plurality of members, an electron source arranged within said envelope and comprising an electron-emitting element having an electroconductive film including an electron-emitting region arranged between a pair of electrodes, and an image forming member for forming images by irradiation of electron beams from said electron source, characterized in that said method comprises a step of applying a bonding agent to predetermined areas of the surfaces of said plurality of members followed by calcination and a step of heating said plurality of members to bond them together to produce said envelope in an atmosphere containing at least a gas selected from reducing gases, inert gases and non-reducing and non-oxidizing gases or in a vacuum, said step being carried out prior to a step of generating an electron-emitting region in the electroconductive film.

Now, the invention will be described in greater detail by referring to the accompanying drawings that illustrate the best modes of carrying out the invention.

DETAILED DESCRIPTION OF THE PREFERRED EMBODIMENTS

Figure 1:
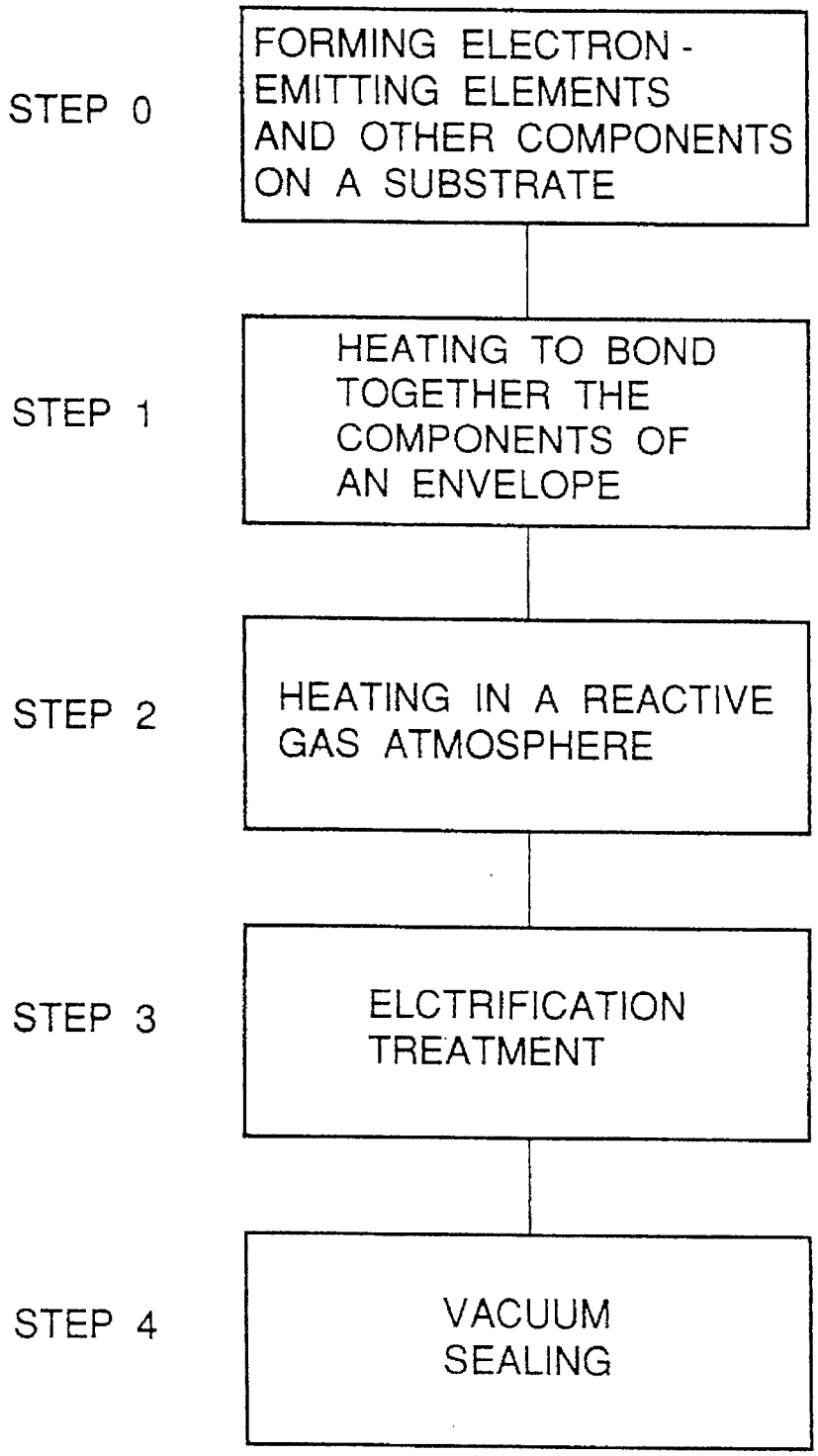
FIG. 1 is a flow chart of a method of manufacturing an image-forming apparatus according to the invention.

A method of manufacturing an image-forming apparatus according to the invention is characterized initially in that it comprises a step of hermetically sealing an envelope formed by a plurality of members. More specifically, the hermetically sealing step consists in heating the plurality of members for an envelope to bond them together in an atmosphere containing at least a gas selected from reducing gases, inert gases and non-reducing and non-oxidizing gases or in a vacuum. Such a step can minimize the formation of oxide film on the element electrodes of each electron-emitting element and the wiring electrodes connecting electron-emitting elements during the process of manufacturing an image-forming apparatus so that the disadvantage of an increase in the element resistance and the wiring resistance of each of the electron-emitting elements of a conventional image-forming apparatus manufactured by a known method can be practically eliminated and consequently the power consumption rate of the manufactured apparatus can be minimized.

Secondly, the above described hermetically sealing step is advantageous in that, if an even distribution of temperature is not rigorously observed on the apparatus during the step, the disadvantage of varied electron emission rates and consequent improperly illuminated images on the display screen of a conventional image-forming apparatus due to the formation of oxide film can be practically avoided.

Finally, if it is used to manufacture an image-forming apparatus comprising surface conduction electron-emitting elements, each having a electro-conductive film including an electron-emitting region (a thin film for electron emission) arranged between a pair of electrodes, it can practically eliminate the known disadvantage that the metal of the element electrodes of the surface conduction electron-emitting elements of the apparatus is apt to be oxidized during the manufacturing process particularly at the interfaces of the thin film including an electron-emitting region and the element electrodes of each element to increase the electric resistance of the element so that, at worst, no electricity may be allowed to flow therethrough, making the element totally inoperative. If the operation of forming is carried out for the surface conduction electron-emitting elements after the above described hermetically sealing step, the forming operation will not consume electric energy at any enhanced rate unlike the case of any known comparable manufacturing methods because practically no oxide film is formed and the electric resistance of the elements is not raised during the hermetically sealing step.

If a method according to the invention is used to manufacture an image-forming apparatus comprising surface conduction electron-emitting elements, each having a electro-conductive film including an electron-emitting region arranged between a pair of electrodes, it preferably comprises a step of heating the thin film for electron emission of each electron-emitting element in an atmosphere containing at least one or more than one of the substantial elements of the thin film for electron emission in addition to the hermetically sealing step.

This is because an electron-emitting element such as a surface conduction electron-emitting element having a electroconductive film including an electron-emitting region arranged between a pair of electrodes can be chemically affected by heat during the hermetically sealing step so that a thin film for electron emission having a desired chemical composition may not be obtained after all. Therefore, by employing a step of heating the thin film for electron emission of each electron-emitting element in an atmosphere containing at least one or more than one of the substantial elements of the thin film for electron emission in addition to the hermetically sealing step, the thin film may come to show a desired chemical composition because of a thermochemical reaction of the thin film for electron emission and the gases in the atmosphere that takes place after the hermetically sealing step.

The above described heating step to be conducted in a specific atmosphere is also advantageous in that, while the thin film for electron emission of each electron-emitting element such as a surface conduction electron-emitting element formed between the electrodes of the element by spinner coating or vapor deposition of a chemical substance may not show a desired and intended chemical composition, this problem of formation of a thin film having an undesired chemical composition can be avoided by heating the thin film for electron emission in an atmosphere containing at least one or more than one of the substantial elements of the thin film for electron emission. For the above described reasons, the heating step preferably comes after the hermetically sealing step.

Now, the present invention will be described by way of a best mode of carrying out the invention.

Figure 4:
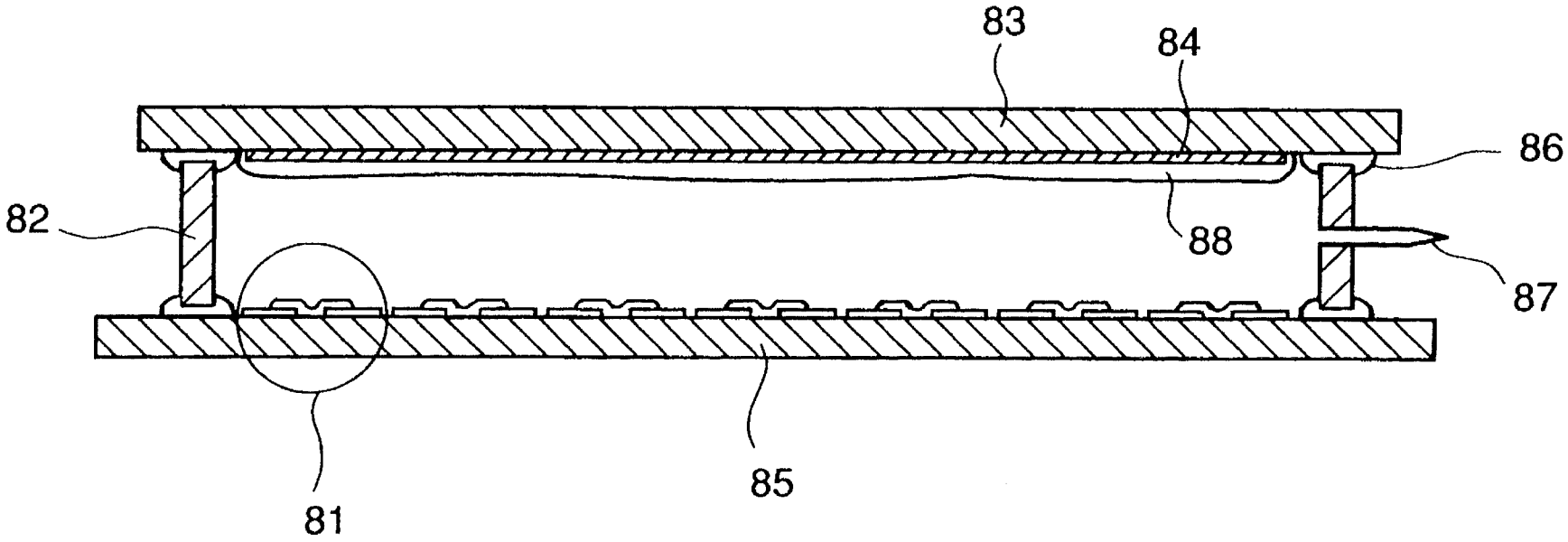
FIG. 4 is a schematic sectional view of an image-forming apparatus according to the invention.
Figure 5:
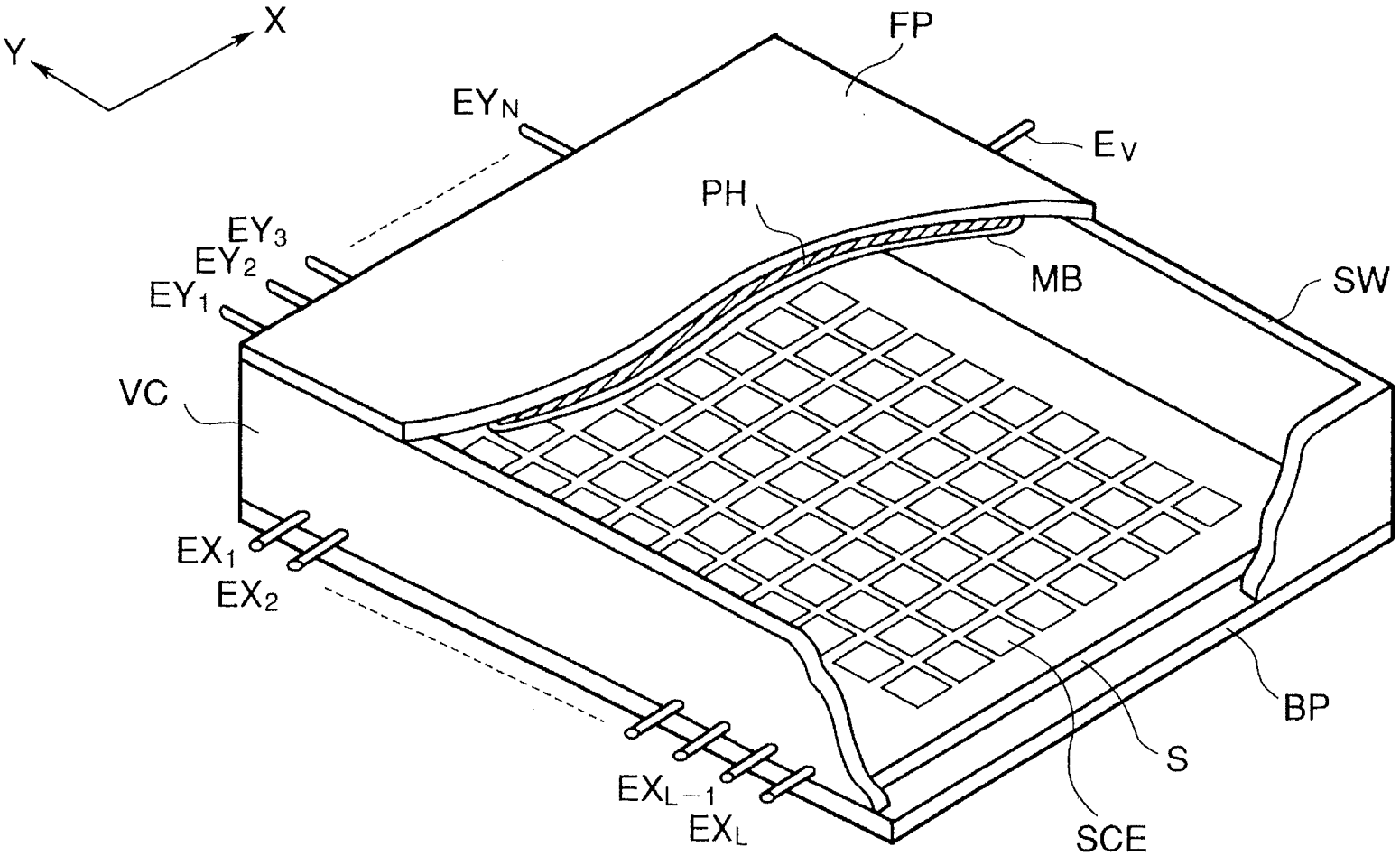
FIG. 5 is a partially cut-out schematic perspective view of an image-forming apparatus according to the invention.

FIG. 1 shows a flow chart of a method of manufacturing an image-forming apparatus according to the invention. This flow chart may be appropriately used to manufacture an image-forming apparatus as illustrated in FIG. 4.

Referring to FIG. 1, in step 0, a plurality of surface conduction electron-emitting elements, each having an electron-emitting region generating thin film (thin film for electron emission), and wires for feeding the elements with electric power are arranged on a substrate. This step, or step 0, will be described below in greater detail by referring to FIGS. 3 and 4.

Figure 3:
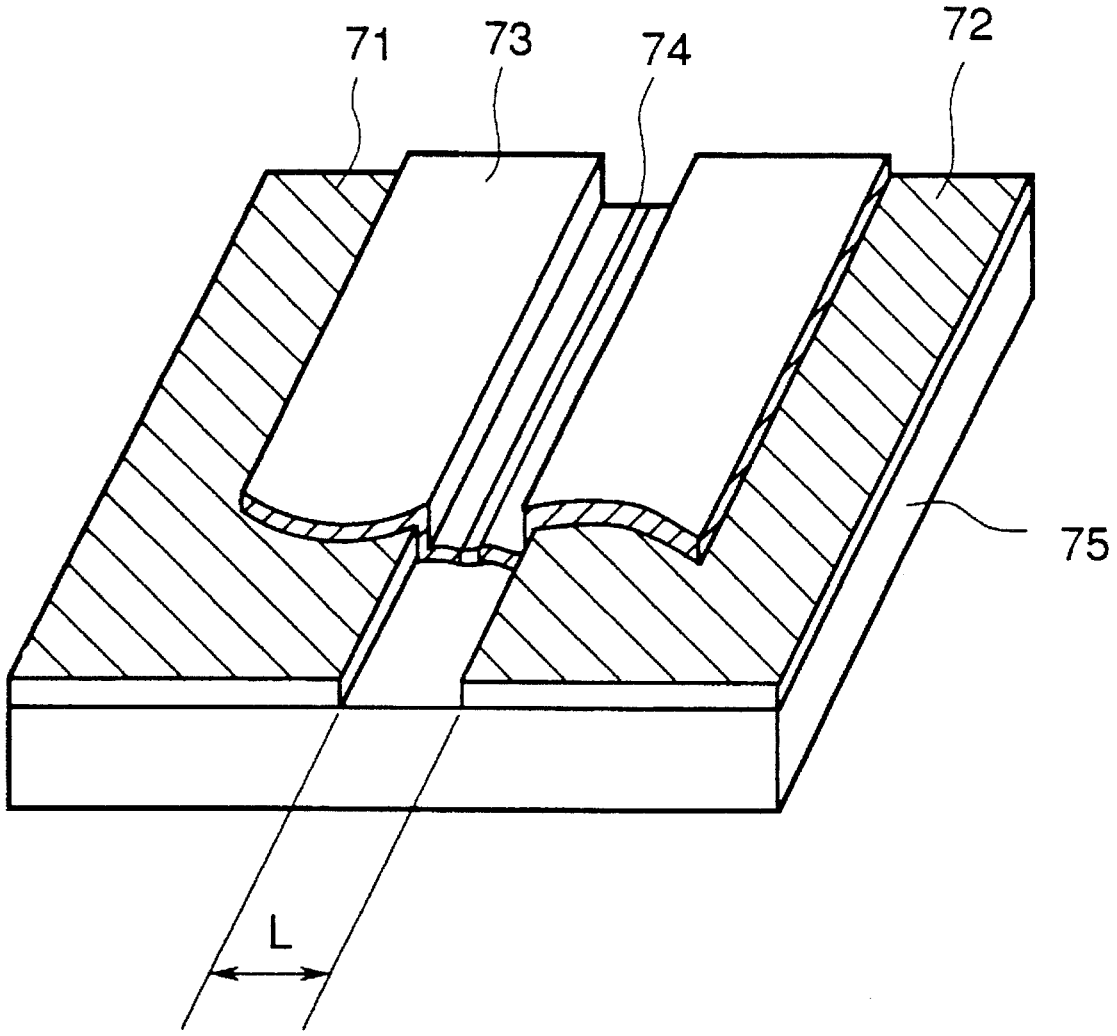
FIG. 3 is a schematic perspective view of a surface conduction electron-emitting element to be used for an image-forming apparatus according to the invention.

The surface of a substrate 85 made of an insulating material such as glass or a ceramic substance is thoroughly cleansed in advance and a plurality of surface conduction electron-emitting elements 81 that have not been subjected to a forming operation (an operation for generating an electron-emitting region in each element) and each of which has a configuration as schematically shown in FIG. 3 are arranged on the surface of the substrate 85. In the course of this step, a film of a metal such as Cu, Ni, Al or Ti is formed to a thickness of 500 to 5,000 angstroms by means of a known film forming technique such as vapor deposition or sputtering and a resist pattern is formed for a pair of electrodes 71, 72 of each element. Then, the film is etched to produce the electrodes 71, 72 for each element that is separated from each other by L, which is equal to several microns. Note that the electrodes may alternatively be prepared by using a technique called lift-off.

Thereafter, an electron-emitting region generating thin film is formed to fill the gap between the electrodes 71, 72 and partly cover the electrodes. The thin film typically has a length of several hundred microns nad a width of tens of several microns. Although the electron-emitting region generating thin film is preferably made of a metal selected from Ti, Nb, Sn, Cr, Zn, Rh, Hf and Pd, a compound containing at least one of the above mentioned metals, a semiconductive substance such as Si or Ge or a compound containing at least one of the above mentioned semiconductive substances, it may be made of an appropriate material other than the above substances if the electron-emitting region generating thin film shows a resistance of several ohms to several mega-ohms per unit square after the completion of the second step, which will be described later.

While an electron-emitting region generating thin film may preferably be prepared for the purpose of the present invention by vapor deposition, sputtering or spinner coating of a solution containing one of the above mentioned metals and semiconductive substances or chemical compounds containing such a substance, any other appropriate method may alternatively be used. The electron-emitting region generating thin film prepared in the above step may be in the state of continuous film, fine particles or a composite thereof.

Figure 6:
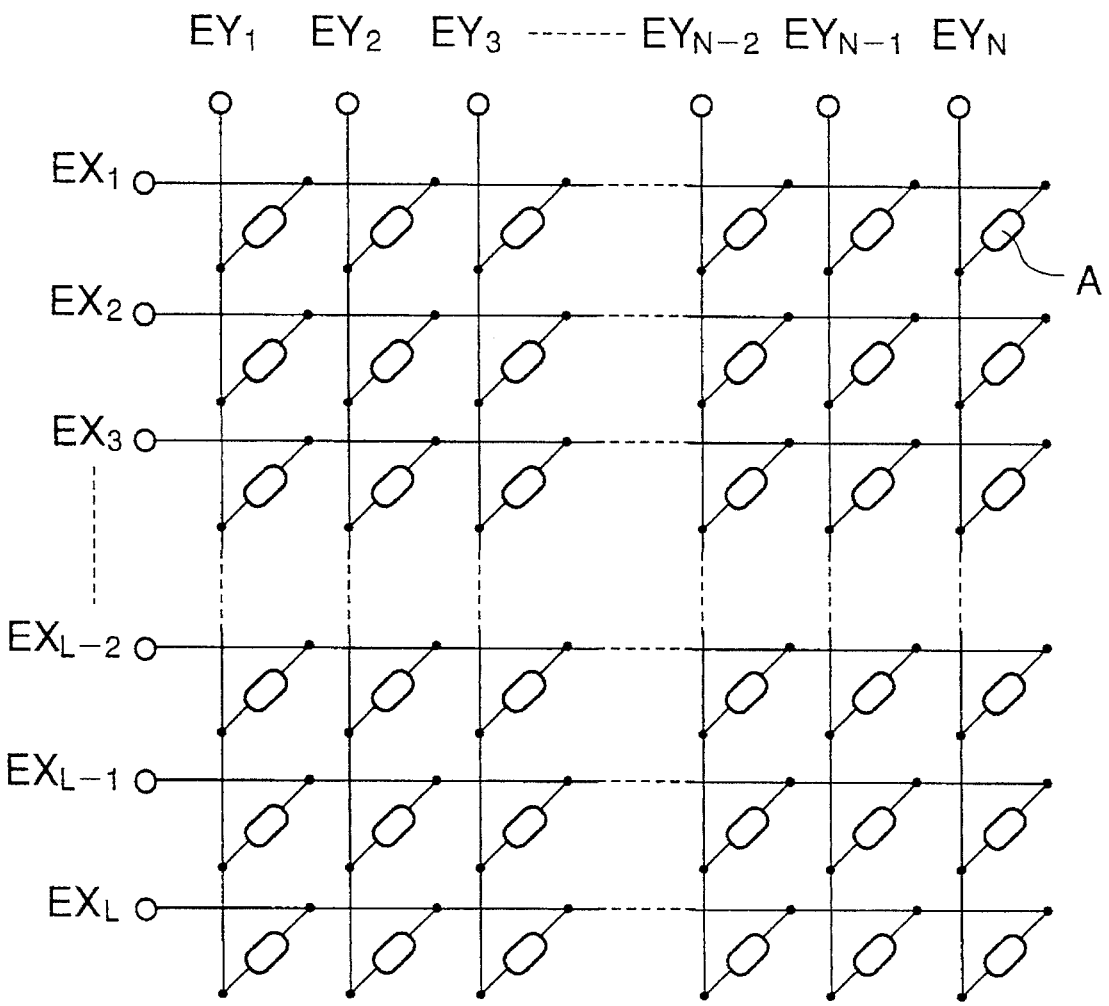
FIG. 6 is a schematic view illustrating a simple matrix wiring arrangement of an electron-emitting element to be used for an image-forming apparatus according to the invention.
Figure 7:
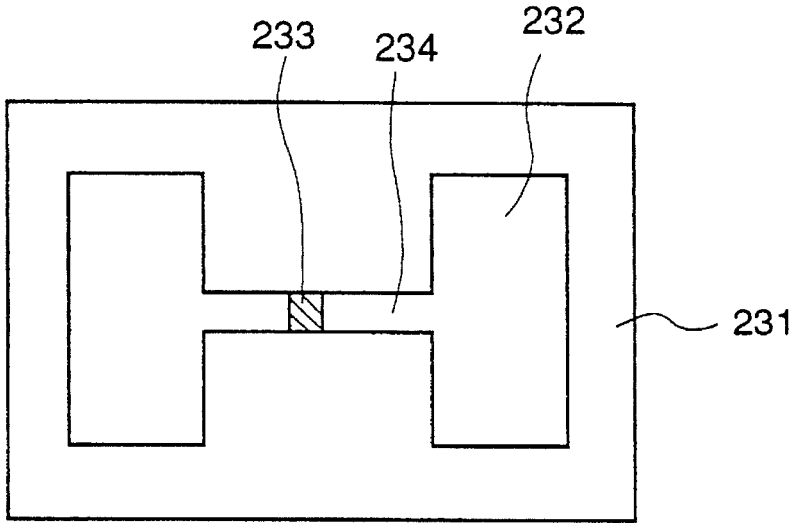
FIG. 7 PRIOR ART
FIG. 7 is a schematic plan view of a conventional surface conduction electron-emitting element.
Figure 8:
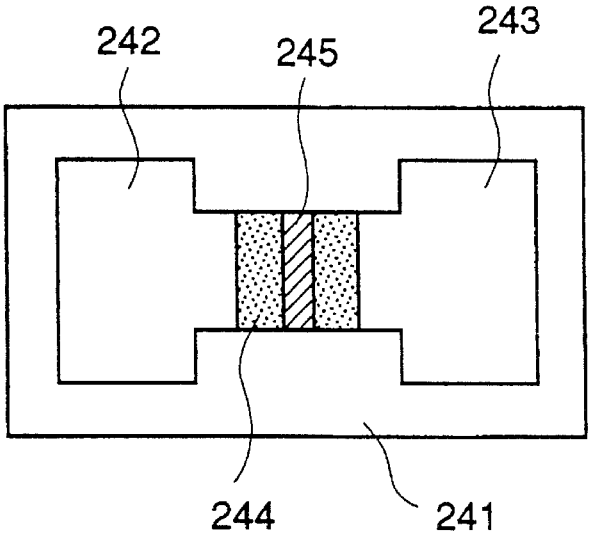
FIG. 8 PRIOR ART
FIG. 8 is a schematic plan view of another conventional surface conduction electron-emitting element.

Subsequently, a pattern of wires (not shown) is formed for feeding the plurality of surface conduction electron-emitting elements 81 with electric power. The material to be used for the wires is preferably a low resistance metal such as Cu or Al and the pattern of wires typically has a thickness of several microns. The technique of forming the electrodes 71, 72 may also be used for producing the wire pattern. If the pattern of wires is realized in the form of a simple matrix comprising a plurality of wires arranged along the direction of X (EX1, EX2, . . . ) and those arranged along the direction of Y (EY1, EY2, EY3, . . . ) as illustrated in FIG. 6, an insulation layer may be disposed between each of the X-directional wires and each of the Y-directional wires at and around the crossing thereof, such insulation layers may be prepared in a manner as they are formed in the course of manufacturing an ordinary semiconductor device. Note that A in FIG. 6 denotes an electron-emitting element such as a surface conduction electron-emitting element.

Step 1 in FIG. 1 is a step where the operation of hermetically sealing the envelope of an image-forming apparatus according to the invention is carried out. As described earlier, this step provides an image-forming apparatus according to the invention with a very significant feature. Now, this hermetically sealing step will be described in greater detail. While the envelope (panel) comprises a face plate 83, spacers 82 and a substrate 85 in FIG. 4, for the purpose of the present invention, the face plate 83 and the spacers 82 or the spacers 82 and the substrate 85 may alternatively be supplied as an integrated single component that has been prepared in advance.

Referring to FIG. 4, frit glass 86 is applied to the bonding areas of the face plate 83 carrying a phosphor layer 84 and a metal back layer 88 in its inner surface and/or those of the spacers 82 and the face plate 83 and the spacers 82 are calcined along with the applied frit glass 86 before they are baked and bonded together. Frit glass 86 is also applied to the bonding areas of the spacers 82 and/or those of the substrate 85 and then they are calcined. The calcining operation is necessary to remove the organic binding agent contained in the applied frit glass and is normally conducted at a temperature lower than the temperature at which the baking operation is conducted. The latter operation will be described later in greater detail. Thereafter the assemblage of the face plate 83 and the spacers 82 is properly aligned and firmly held to the substrate 85 and then these components are put into a furnace as illustrated in FIG. 2 which is provided with a container that can be airtightly sealed and evacuated to heat the entire assemblage contained therein and produce a complete envelope.

Figure 2:
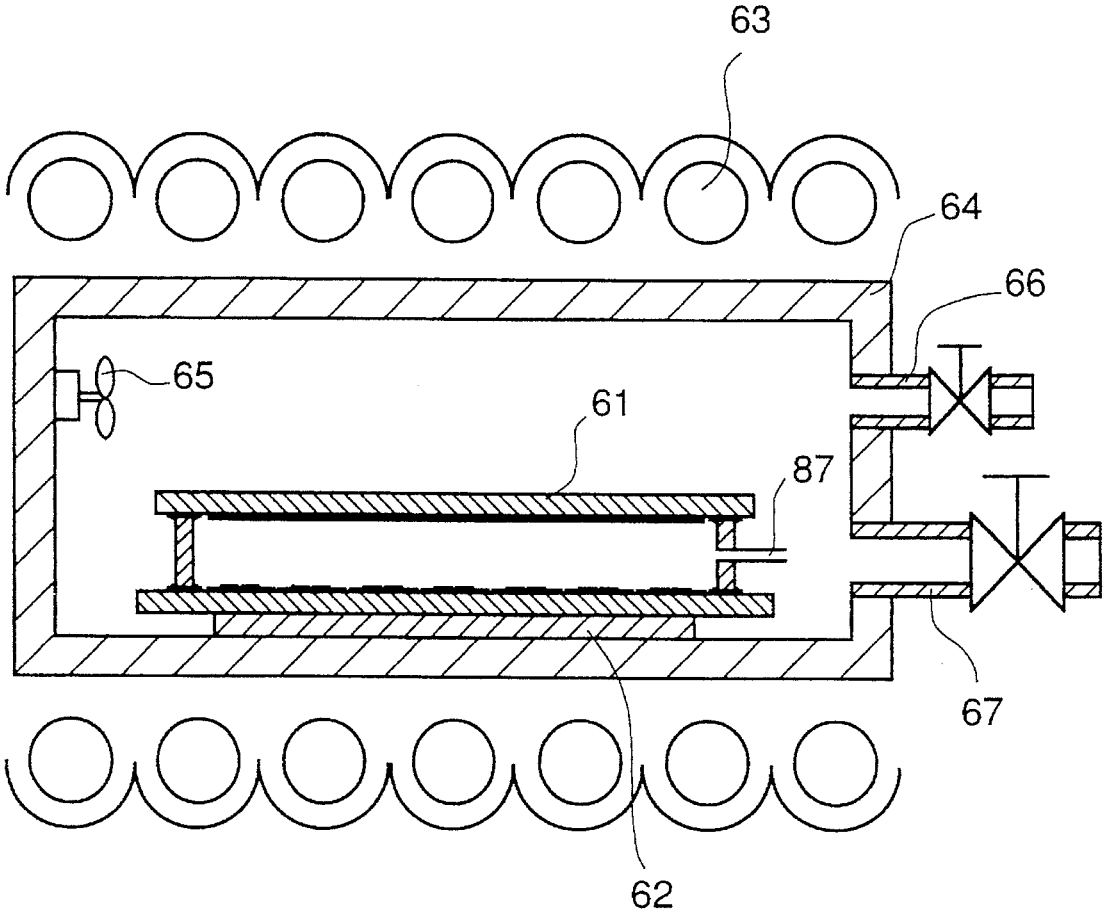
FIG. 2 is a sectional view of an apparatus to be used for the first and second steps of a method of manufacturing and image-forming apparatus according to the invention.

Referring to FIG. 2, the furnace comprises heating lamps 63 and a container 64 for containing an envelope 61 to be thermally processed therein, said container 64 being provided with a support table 62, a stirrer 65 for achieving an even distribution of temperature within the container, a gas inlet port 66 equipped with a valve and an exhaust port 67 also equipped with a valve. The container can be airtightly sealed and evacuated as described above and its walls are made of a material that can transmit beams irradiated from the heating lamps 63.

In operation, the valve of the exhaust port 67 is opened to evacuate the container 64 by means of a vacuum pump (not shown) to a pressure of not higher than $10^{-4}$ Torr. Once the intended degree of vacuum is achieved within the container, the valve of the exhaust port 67 is closed and the vale of the gas inlet port 66 is opened to allow a reducing gas such as $H_2$ or CO, an inert gas such as He, Ar, Ne, Kr or Xe, a non-reducing and non-oxidizing gas such as $N_2$, $CO_2$ or $CF_4$ or a mixture of any of these to enter the container and shows a pressure between several to several thousand torrs inside the container although the inside pressure of the container is normally held to a level equal to the atmospheric pressure. Note that the atmosphere in the container prevails the inside of the envelope 61 and the pressure of the inside of the envelope 61 is held equal to that of the inside of the container 64 during this step because the exhaust pipe 87 is not sealed yet. Also note that the container 64 may be heated in a vacuum without filling it with gas and using a stirrer if an even distribution of temperature is not required within the container 64.

Thereafter, the heating lamps 63 are energized to heat the inside of the container 64 at a temperature appropriate for melting the frit glass which is typically 450° C. for approximately an hour, while operating the stirrer 65. Subsequently, the envelope is slowly and gradually cooled to ambient temperature.

Referring again to FIG. 1, step 2 is a step where the thin film for electron emission of the apparatus is heated in an atmosphere containing at least part of the elements that constitute the thin film. This step will now be described below in greater detail.

As in step 1 described above, the container 64 is evacuated to a pressure of not higher than $10^{31\ 4}$ Torr. Then, the valve of the exhaust port 67 is closed and that of the gas inlet port 66 is opened to allow gas inter the container, said gas being capable of thermochemically change the metal or the semiconductor contained in the thin film for electron emission 73 prepared in step 0 to a substance that can emit electrons. Thus, an oxidizing gas such as $\mathbf{0}_2$ or $NO_2$ will be suitably used to produce a thin film of an oxide such as $SnO_2$ or PdO, whereas $N_2$ or $NH_3$ will be introduced into the container if a thin film of a nitride needs to be prepared. The gas pressure in the container 64 is held to several to several thousand torrs although the inside pressure of the container is desirably equal to the atmospheric pressure. Note again that the atmosphere in the container prevails the inside of the envelope 61 and the pressure of the inside of the envelope 61 is held equal to that of the inside of the container 64 during this step because the exhaust pipe 87 is not sealed yet. The heating temperature in step 2 needs to be equal to or higher than the temperature at which a desired chemical compound for electron emission is formed and, at the same time, it needs to be not higher than the temperature at which the material of the electrodes 71, 72 chemically reacts with the gas introduced into the container 64 and produces an insulating compound if such a chemically reactive material is used for the electrodes 71, 72. For example, if the electrodes 71, 72 are made of Ni and PdO is produced in an $0_2$ atmosphere for electron emission, the heating temperature needs to be between 150° and 320° C. Then, the heating operation will be continued for several minutes to several hours and, subsequently, the image-forming apparatus will be allowed to become sufficiently cold before it is taken out of the furnace.

It should be noted that, while a furnace having a configuration as illustrated in FIG. 2 is used in the above description, a furnace of any other type may alternatively be used if an image-forming apparatus according to the invention can be heated in a desired atmosphere to a desired temperature for a given period of time.

Thereafter, step 3 takes place. In this step, the image-forming apparatus in the container is evacuated by means of an exhaust pipe 87 and a vacuum pump such as a turbo molecular pump (not shown) to achieve a pressure of not higher than $10^{-6}$ Torr within the apparatus. Then, the electron-emitting regions 74 of the apparatus are formed by applying a voltage of several to tens of several volts to the electrodes 71, 72 of each electron-emitting element by way of wires.

Subsequently, step 4 is carried out. In this step, the image-forming apparatus is heated by heating means such as a hot plate (not shown) to a temperature that does not cause the material of the electron-emitting elements which is typically an oxide or nitride to be reduced and then evacuated by means of the exhaust pipe 87 over several days to achieve a pressure of not higher than $10^{-6}$ Torr within the image-forming apparatus. After the getter (not shown) that has been arranged in the vacuum container containing the image-forming apparatus is made to evaporate, the exhaust pipe 87 is heated and sealed by means of a gas burner.

At the end of step 4, the image-forming apparatus is finished, although steps 1 and 2 provide a remarkable feature to a method of manufacturing an image-forming apparatus according to an aspect of the invention and, therefore, the remaining steps are not limited to those described above.

Now, the present invention will be described further by way of examples.

[Example 1]

A sample image-forming apparatus having a configuration as shown in FIG. 4 and comprising an electron source having a large number of surface conduction electron-emitting elements arranged in array was prepared by a method according to an aspect of the invention.

PdO was used for the electron-emitting region forming thin film 73 of each surface conduction electron-emitting element shown in FIG. 3.

Now, the process of preparing this sample of image-forming apparatus will be described below in detail.

In terms of each surface conduction electron-emitting element, a pair of nickel element electrodes 71, 72 were firstly formed on a glass substrate by lift-off to a thickness of 1,000 angstroms. The electrodes were separated from each other by a gap which was 400 microns long and 2 microns wide.

Then, an organic Pd solution (Catapaste ccp: available from Okuno Pharmaceutical Industries Co., Ltd.) was applied to the assemblage of the element electrodes by spinner coating and the substrate, which were subsequently baked at 300° C. for fifteen minutes.

Thereafter, the assemblage of the element electrodes and the substrate was subjected to a patterning operation using a resist pattern and then an etching operation to produce an electron-emitting region generating thin film 73 to fill the gap between the element electrodes 71, 72 and partly cover the element electrodes. The thin film 73 was principally made of PdO and had a length of 280 microns along the gap and a width of 30 microns.

A total of 600×400 identical elements were arranged on the glass substrate in the form of a matrix, although they had not as yet an electron-emitting region on each of them.

Then, another patterning operation using a resist pattern and a subsequent etching operation were carried out to wire the elements with an aluminum wire pattern having a thickness of 1 micron.

Thereafter, the process of preparing the sample proceeded to step 1.

Referring to FIG. 4, frit glass 86 (LS-0206: available from Nippon Electric Glass Co., Ltd.) was applied to appropriate areas of a face plate 83 on which a phosphor layer and a metal back layer had been formed to give it electroconductivity and 5 mm long spacers 82, which were subsequently calcined at 400° C. for ten minutes and then baked at 450° C. for an hour to firmly bond the spacers 82 to the face plate 83. Then, frit glass 86 was applied to appropriate areas of the spacers 82 that were to be put to contact with the substrate 85 and subsequently calcined at 400° C. for ten minutes.

Then, the member that had been produced by assembling the face plate 83 and the spacers 82 and the substrate 85 carrying the matrix of the elements 81 were aligned relative to each other to form an envelope (panel), which was then placed in a furnace as illustrated in FIG. 2. The container of the furnace of FIG. 2 was evacuated to a pressure of not higher than $10^{-4}$ Torr and thereafter a gaseous mixture of $N_2$ (90%) and $H_2$ (10%) was introduced into the container to maintain the inside pressure of the container equal to the atmospheric pressure. Then, the stirrer 65 was operated and the heating lamps were energized to heat the envelope at 450° C. for an hour, at the end of which all the components of the envelope were firmly bonded together by molten frit glass 86.

Thereafter, step 2 was carried out for the process of preparing the sample.

The envelope was cooled to 50° C. in the container 64, which was then evacuated to a pressure of not higher than $10^{-4}$ Torr. Subsequently, $O_2$ gas was introduced into the container 64 to maintain the inside pressure of the container equal to the atmospheric pressure. Then, the stirrer 65 was operated and the heating lamps were energized to heat the envelope at 320° C. for an hour, at the end of which the electron-emitting region forming thin film 73 of each element was found to have been oxidized.

Thereafter, the envelope was cooled to room temperature and the envelope was taken out of the furnace. When tested, each element of the image-forming apparatus showed a level of electric resistance between 200 and 300 ohms, which was substantially equal to the electric resistance of an element that had not been heated in steps 1 and 2.

Then, the envelope was evacuated by means of the exhaust pipe 87 and a turbo molecular pump (not shown) to a pressure of not higher than $10^{-6}$ Torr. Subsequently, a voltage of 5 V was applied to the pair of element electrodes 71, 72 of each element of the image-forming apparatus by way of appropriate wires so that each element was subjected to an electrification treatment using an electric current of approximately 20 mA to finally produce an electron-emitting region 74 in the electron-emitting region generating thin film 73 of the element.

Thereafter, the envelope was heated to approximately 130° C. by means of a hot plate and then evacuated to a pressure of not higher than $10^{-6}$ Torr over several days. After the getter (not shown) that had been arranged in the vacuum container containing the image-forming apparatus was made to evaporate, the exhaust pipe 87 was heated and sealed by means of a gas burner.

When the finished image-forming apparatus was connected to a drive circuit to make it display images, it was found that the displayed images showed a high degree of evenness in the brightness with a deviation of only about 8%.

[Comparative Example 1]

In order to evaluate the sample image-forming apparatus of Example 1 above, a similar apparatus was prepared for comparison by following the process of Example 1 except that air was used in place of the mixture gas of $N_2$ and $H_2$ in step 1 to provide an atmosphere for the bonding operation using molten frit glass 86, although the inside pressure of the container was held equal to the atmospheric pressure and that step 2 was completely omitted.

When the sample for comparison was cooled to room temperature and taken out of the container to determine the electric resistance of each element 81 of the apparatus after its major components had been bonded together with molten frit glass 86 in the container filled with air to show a pressure equal to the atmospheric pressure, it was discovered that the elements 81 had an enhanced electric resistance ranging from 1 up to 500 kohms, revealing a wide variance existing there. When each element of the apparatus was subjected to an electrification treatment to produce an electron-emitting region 74 out of its electron-emitting region generating thin film 73, the required electric power was twice to five times greater than the power used for Example 1.

When the finished image-forming apparatus was connected to a drive circuit to make it display images, it was found that the displayed images showed a poor degree of evenness in the brightness with a deviation of approximately as high as 50%.

[Example 2]

A sample image-forming apparatus having a configuration as shown in FIG. 4 and comprising an electron source having a large number of surface conduction electron-emitting elements arranged in array was prepared by a method according to another aspect of the invention.

SnOX (x=l to 2) was used for the electron-emitting region generating thin film 73 of each surface conduction electron-emitting element shown in FIG. 3.

Now, the process of preparing this sample of image-forming apparatus will be described below in detail.

In terms of each surface conduction electron-emitting element, a pair of chromium element electrodes 71, 72 were firstly formed on a glass substrate by lift-off to a thickness of 1,000 angstroms. The electrodes were separated from each other by a gap which was 400 microns long and 2 microns wide.

Then, a film of Sn was formed on the assemblage of the element electrodes and the substrate by electron beam vapor deposition to a thickness of 100 angstroms. Thereafter, the assemblage was subjected to a patterning operation using a resist pattern and then an etching operation to produce an electron-emitting region generating thin film 73 to fill the gap between the element electrodes 71, 72 and partly cover the element electrodes. The thin film 73 was principally made of SnOx (x=l to 2) and had a length of 280 microns along the gap and a width of 30 microns.

A total of 600×400 identical elements were arranged on the glass substrate in the form of a matrix, although they had not as yet an electron-emitting region on each of them.

Then, another patterning operation using a resist pattern and a subsequent etching operation were carried out to wire the elements with an aluminum wire pattern having a thickness of 1 micron.

Thereafter, the operations of step 1 were carried out in a manner the same as in the case of Example 1 except that Ar gas was used in place of the mixture gas of $N_2$ and $H_2$ to maintain the inside of the container to the atmospheric pressure.

Subsequently, the operations of step 2 were carried out in a manner the same as in the case of Example 1 except that $NO_2$ gas was used in place of $O_2$ gas to maintain the inside of the container to the atmospheric pressure and that the assemblage was heated at 300° C. for an hour to produce an electron-emitting region generating thin film 73 for each element.

Then an image-forming apparatus was prepared as in the case of Example 1.

When the finished image-forming apparatus was connected to a drive circuit to make it display images, it was found that the displayed images showed a high degree of evenness in the brightness with a deviation of only about 9%.

[Comparative Example 2]

In order to evaluate the sample image-forming apparatus of Example 2 above, a similar apparatus was prepared for comparison by following the process of Example 1 except that air was used in place of the Ar gas in step 1 to provide an atmosphere for the bonding operation using molten frit glass 86, although the inside pressure of the container was held equal to the atmospheric pressure and that step 2 was completely omitted.

When the sample for comparison was cooled to room temperature and taken out of the container to determine the electric resistance of each element 81 of the apparatus after its major components had been bonded together with molten frit glass 86 in the container filled with air to show a pressure equal to the atmospheric pressure, it was discovered that the elements 81 had an enhanced electric resistance ranging from 2 up to 100 kohms, revealing a wide variance existing there. When each element of the apparatus was subjected to an electrification treatment to produce an electron-emitting region 74 out of its electron-emitting region generating thin film 73, the required electric power was three to eight times greater than the power used for Example 2.

When the finished image-forming apparatus was connected to a drive circuit to make it display images, it was found that the displayed images showed a poor degree of evenness in the brightness with a deviation of approximately as high as 60%.

[Example 3]

A sample image-forming apparatus having a configuration as shown in FIG. 4 and comprising an electron source having a large number of surface conduction electron-emitting elements arranged in array was prepared by a method according to still another aspect of the invention.

ZnNx (x=l to 2) was used for the electron-emitting region generating thin film 73 of each surface conduction electron-emitting element shown in FIG. 3.

Now, the process of preparing this sample of image-forming apparatus will be described below in detail.

In terms of each surface conduction electron-emitting element, a pair of copper element electrodes 71, 72 were firstly formed on a glass substrate by lift-off to a thickness of 1,000 angstroms. The electrodes were separated from each other by a gap which was 400 microns long and 2 microns wide.

Then, a film of Zn was formed on the assemblage of the element electrodes and the substrate by ion beam vapor deposition to a thickness of 80 angstroms. Thereafter, the assemblage was subjected to a patterning operation using a resist pattern and then an etching operation to produce an electron-emitting region generating thin film 73 to fill the gap between the element electrodes 71, 72 and partly cover the element electrodes. The thin film 73 was principally made of Zn and had a length of 280 microns along the gap and a width of 30 microns.

A total of 600×400 identical elements were arranged on the glass substrate in the form of a matrix, although they had not an electron-emitting region on each of them yet.

Then, another patterning operation using a resist pattern and a subsequent etching operation were carried out to wire the elements with an aluminum wire pattern having a thickness of 1 micron.

Thereafter, the operations of step 1 were carried out in a manner the same as in the case of Example 1 except that CO gas was used in place of the mixture gas of $N_2$ and $H_2$ to maintain the inside of the container to the atmospheric pressure.

Subsequently, the operations of step 2 were carried out in a manner same as in the case of Example 1 except that $N_2$ gas was used in place of $O_2$ gas to maintain the inside of the container to the atmospheric pressure and that the assemblage was heated at 300° C. for an hour to produce an electron-emitting region forming thin film 73 for each element.

It should be noted that, when ZnNx is used for an electron-emitting region forming thin film, the operations of step 2 will be most successfully carried out by following those of this example because a ZnNx film can hardly be processed for patterning particularly in the initial stages.

Then an image-forming apparatus was prepared as in the case of Example 1.

When the finished image-forming apparatus was connected to a drive circuit to make it display images, it was found that the displayed images showed a high degree of evenness in the brightness with a deviation of only about 8%.

[Comparative Example 3]

An apparatus similar to that of Example 3 was prepared for comparison by following the process of Example 3 except that air was used in place of the CO gas in step 1 to provide an atmosphere for the bonding operation using molten frit glass 86, although the inside pressure of the container was held equal to the atmospheric pressure and that step 2 was completely omitted.

When the finished image-forming apparatus was connected to a drive circuit to make it display images, it was found that the displayed images showed a poor degree of evenness in the brightness with a deviation of approximately as high as 50%.

[Example 4]

In the example, a sample image-forming apparatus was prepared in a manner same as in the case of Example 1, although the operations of step 1 were carried out in vacuum.

Then, the operation of hermetically sealing the envelope (panel) of the sample apparatus was carried out as in the case of Example 1 except that, after placing the envelope in the container 64 of a furnace as shown in FIG. 2, the container 64 was evacuated to a pressure of not higher than $10^{-4}$ Torr and thereafter the heating lamps 63 were energized to heat the apparatus at 450° C. for an hour in order to melt the frit glass 86 and bond the related components together.

When the finished image-forming apparatus was connected to a drive circuit to make it display images, it was found that the displayed images showed a high degree of evenness in the brightness with a deviation of only about 8%.

[Advantages of the Invention]

As described above in detail, according to the invention, there is provided a method of manufacturing an image-forming apparatus that can display high quality images and operate with a reduced rate of power consumption and a reduced variance in the rate of electron emission among a plurality of electron-emitting elements arranged therein for image display by minimizing the production of oxide film in the operation of melting frit glass and bonding the related components of the apparatus (the operation of hermetically sealing the envelope of the apparatus). An image-forming apparatus manufactured by such a method also constitutes part of the present invention.

In particular, according to the invention, there is provided a method of manufacturing an image-forming apparatus comprising surface conduction electron-emitting elements that can display high quality images and operate with a reduced rate of power consumption. An image-forming apparatus manufactured by such a method also constitutes part of the present invention.

What is claimed is:

1. A method of manufacturing an image-forming apparatus comprising an envelope formed by a plurality of members, an electron source arranged within said envelope and comprising an electron-emitting element having an electroconductive film including an electron-emitting region arranged between a pair of electrodes, and an image forming member for forming images by irradiation of electron beams from said electron source, characterized in that said method comprises a step of heating said plurality of members to bond them together to produce said envelope in an atmosphere containing at least a gas selected from reducing gases, inert gases and non-reducing and non-oxidizing gases or in a vacuum, said step of heating said plurality of members being carried out prior to a step of generating an electron-emitting region in the electroconductive film.

2. A method of manufacturing an image-forming apparatus according to claim 1, wherein said method further comprises a step of heating the electroconductive film in an atmosphere containing at least one of the substantial elements constituting the conductive film in the form of a gas, said step of heating the electroconductive film being carried out prior to the step of generating an electron-emitting region in the electroconductive film.

3. A method of manufacturing an image-forming apparatus according to claim 1, wherein said step of generating an electron-emitting region in the electroconductive film includes an operation of electrification treatment of the electroconductive film.

4. An method of manufacturing an image-forming apparatus according to claim 3, wherein said method further comprises a step of heating the electroconductive film in an atmosphere containing at least one of the substantial elements constituting the conductive film in the form of a gas, said step of heating the electroconductive film being carried out prior to the step of generating an electron-emitting region in the electroconductive film.

5. A method of manufacturing an image-forming apparatus comprising an envelope formed by a plurality of members, an electron source arranged within said envelope and comprising an electron-emitting element having an electroconductive film including an electron-emitting region arranged between a pair of electrodes, and an image forming member for forming images by irradiation of electron beams from said electron source, characterized in that said method comprises a step of applying a bonding agent to predetermined areas of the surfaces of said plurality of members followed by calcination and a step of heating said plurality of members to bond them together to produce said envelope in an atmosphere containing at least a gas selected from reducing gases, inert gases and non-reducing and nonoxidizing gases or in a vacuum, said step of heating being carried out prior to a step of generating an electron-emitting region in the electroconductive film.

6. A method of manufacturing an image-forming apparatus according to claim 5, wherein the method further comprises a step of heating the electroconductive film in an atmosphere containing at least one of the substantial elements constituting the conductive film in the form of a gas, said step of heating the electroconductive film being carried out prior to the step of forming an electron-emitting region in the electroconductive film of each element.

7. A method of manufacturing an image-forming apparatus according to claim 5, wherein said step of generating an electron-emitting region in the electroconductive film includes an operation of electrification treatment of the electroconductive film.

8. A method of manufacturing an image-forming apparatus according to claim 7, wherein said method further comprises a step of heating the electro-conductive film in an atmosphere containing at least one of the substantial elements constituting the conductive film in the form of a gas, said step of heating the electroconductive film being carried out prior to the step of forming an electron-emitting region in the electroconductive film of each element.

* * * * *

UNITED STATES PATENT AND TRADEMARK OFFICE

CERTIFICATE OF CORRECTION

PATENT NO. : 5,505,647

DATED : January 28, 1996

INVENTOR(S) : Yasue Sato et al.

It is certified that error appears in the above-identified patent and that said Letters Patent is hereby corrected as shown below:

REFERENCES CITED

Foreign Patent Documents,
"6431332 2/1989 Japan
256822 2/1990 Japan" should read
--64-31332 2/1989 Japan
2-56822 2/1990 Japan--.

COLUMN 2

Line 34, "apparatus" should read --apparatuses--.
Line 36, "apparatuses" should read --apparatus--.

COLUMN 6

Line 11, "a" should read --an--.

COLUMN 7

Line 8, "nad" should read --and--.

UNITED STATES PATENT AND TRADEMARK OFFICE

CERTIFICATE OF CORRECTION

PATENT NO. : 5,505,647

DATED : January 28, 1996

INVENTOR(S) : Yasue Sato et al.

It is certified that error appears in the above-identified patent and that said Letters Patent is hereby corrected as shown below:

COLUMN 8

Line 27, "vale" should read --valve--.
Line 56, "$10^{31\ 4}$ Torr." should read --$10^{-4}$ Torr.--.
Line 58, "inter" should read --to enter--.

COLUMN 13

Line 40, "not" should read --not as yet-- and "them yet." should read --them.--.
Line 52, "same" should read --the same--.

COLUMN 15

Line 24, "An" should read --A--.

UNITED STATES PATENT AND TRADEMARK OFFICE

CERTIFICATE OF CORRECTION

PATENT NO. : 5,505,647

DATED : January 28, 1996

INVENTOR(S) : Yasue Sato et al.

It is certified that error appears in the above-identified patent and that said Letters Patent is hereby corrected as shown below:

COLUMN 16

Line 15, "the" should read --said--.

Signed and Sealed this

Tenth Day of September, 1996

*Attest:*

*Attesting Officer*

BRUCE LEHMAN

*Commissioner of Patents and Trademarks*